United States Patent [19]

Laviolette

[11] 4,112,843

[45] Sep. 12, 1978

[54] MODULAR PRACTICE BOMB

[75] Inventor: Maurice A. Laviolette, Quebec, Canada

[73] Assignee: Her Majesty the Queen in right of Canada, as represented by the Minister of National Defence, Canada

[21] Appl. No.: 757,215

[22] Filed: Jan. 6, 1977

[30] Foreign Application Priority Data

Aug. 16, 1976 [CA] Canada ..... 259143

[51] Int. Cl.[2] ..... F42B 25/02

[52] U.S. Cl. ..... 102/7.6; 102/4; 102/92.4; 244/3.3

[58] Field of Search ..... 102/7.6, 4, 2, 92.7; 244/3.24, 3.3

[56] References Cited

U.S. PATENT DOCUMENTS

| | | | |
|---|---|---|---|
| 1,285,083 | 11/1918 | Eskesen | 102/7.6 |
| 2,354,039 | 7/1944 | Mitchell | 102/7.6 |
| 3,412,962 | 11/1968 | Killian | 244/3.3 X |
| 3,485,460 | 12/1969 | Mertens | 102/92.4 X |
| 3,492,911 | 2/1970 | Adams | 102/4 X |
| 3,635,162 | 1/1972 | Lohkamp et al. | 102/7.6 |
| 3,809,339 | 5/1974 | Sieling et al. | 244/3.3 |
| 3,902,683 | 9/1975 | Bilsburg | 102/92.7 X |
| 4,005,655 | 2/1977 | Kleinschmidt et al. | 102/4 |

*Primary Examiner*—David H. Brown

*Attorney, Agent, or Firm*—Stevens, Davis, Miller & Mosher

[57] ABSTRACT

The invention disclosed relates to a Modular Practice Bomb which closely simulates the horizontal range of a wide variety of actual bombs, within acceptable limits, while maintaining flight stability. By suitable modification of a standard configuration practice bomb, its coefficient of drag may be varied in order to match the ballistic coefficient of the Modular Practice Bomb with that of a predetermined actual bomb. This is conveniently done by attaching an appropriate tail-mounted module.

14 Claims, 11 Drawing Figures

MODULAR PRACTICE BOMB

Figure 1:
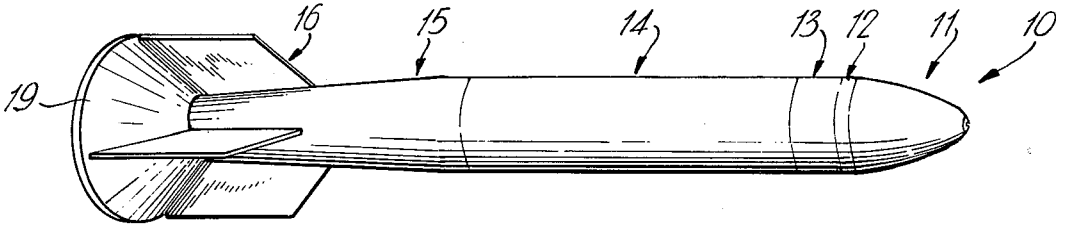

This invention relates to a practice bomb for simulating the flight characteristics of actual bombs, and, in particular, to a Modular Practice Bomb which closely simulates the horizontal range of a wide variety of actual bombs, within acceptable limits.

A number of practice bombs have been developed over the years. The two most commonly used are the BDU-33A/B and MK-106 practice bombs. The MK-106 Pratice Bomb has been modified recently by applicant to improve the simulation of the horizontal range of the MK-82 Snakeye High Drag Bomb. The Modified MK-106 Practice Bomb is the subject of Applicant's copending application Ser. No. 757,192 filed Jan. 6, 1977

The main drawback of these practice bombs is that they generally only serve to closely simulate the flight characteristics of a single bomb. For example, the MK-106 and the BDU-33A/B practice bombs will only effectively simulate the horizontal ranges of the MK-82 Snakeye High-Drag Bomb and the MK-82 Snakeye Low-Drag Bomb, respectively, within specified release flight envelopes. For some release conditions of speed and dive angle, an acceptable simulation of horizontal range is only obtained at one release altitude.

Another disadvantage in the one live bomb - one practice bomb situation is that in most instances, the bomb dispensers require modification to accommodate the different shapes, sizes and weights of the various existing practice bombs and when a new practice bomb is introduced, to satisfy new requirements.

From an economic standpoint, most countries have an inventory consisting of a large number of different live bombs. This means that in theory, up to now, they should have to purchase a corresponding number of different practice bombs in order to train their personnel in the delivery of all of the bombs in their inventory. Obviously, this would run into considerable expense and only a few practice bombs are available to satisfy the requirements.

Furthermore, the length of time required to train aircrews in the delivery of the various practice bombs increases in proportion to the number of different practice bombs in use.

Accordingly, it is an object of the invention to provide a single Modular Practice Bomb (MPB) which closely simulates the horizontal ranges of a variety of different actual bombs under various launch conditions.

According to one aspect of the invention, an improved practice bomb is provided which closely simulates the horizontal range of a predetermined actual bomb, within acceptable limits under various release conditions, said practice bomb comprising:

(a) a nose section,
(b) a cylindrical central body section, and
(c) a tail section including stabilizing fins, the improvement comprising providing a standard configuration modular practice bomb of fixed effective diameter and substantially constant weight, and including means for varying the coefficient of drag of the modular practice bomb in order to closely match the ballistic coefficient of the modular practice bomb with that of a predetermined actual bomb, while maintaining flight stability.

According to another aspect of the invention, a method for closely simulating the horizontal range of a wide variety of actual bombs within acceptable limits under various release conditions is contemplated, comprising providing a standard configuration modular practice bomb of fixed effective diameter and substantially constant weight and varying the coefficient of drag of the modular practice bomb to provide a close match of the ballistic coefficient of the modular practice bomb with that of a predetermined actual bomb, while maintaining flight stability.

Three possible approaches were considered for development to determine which was most promising. The three approaches were:

(a) variable-mass practice bomb,
(b) variable-drag practice bomb, and
(c) best-compromise practice bomb with fixed mass and drag.

The variable-mass concept practice bomb would entail a basic practice bomb to which weight would be added incrementally to allow it to simulate the trajectories of the various weapons. Thus, by closely matching the ballistic coefficient of the practice bomb to that of a predetermined weapon, an acceptable match of the horizontal range can be obtained.

However, the ballistic coefficients of weapons to be simulated cover a wide range. For example, the ballistic coefficient for the MK-82 Snakeye bomb in its high-drag mode is 0.0189 $ft^2/lb$ while that of the low-drag mode is 0.0005 $ft^2/lb$. This means that a basic five-pound practice bomb used to simulate the high-drag MK-82 Snakeye would have to weigh about 189 lb to simulate the low-drag version. This clearly is not feasible. Furthermore, the cost of the practice bomb is roughly proportional to weight and so to keep its costs low, weight must be minimized.

It was found that the best-compromise concept practice bomb with its fixed mass and drag would not match any given weapon closely but would, instead, have a trajectory which lay within the envelope of all inventory weapons at all delivery conditions.

The best approach to this problem was found to be the variable-drag concept practice bomb, which consists of a single practice bomb which has variable drag and ballistic coefficient characteristics which allow it to simulate the horizontal ranges of predetermined live bombs within acceptable limits for specified release envelopes. Theoretically, the horizontal range would be matched exactly if the ballistic coefficient and release conditions of the practice bomb are perfectly matched with those of the actual bomb. However, there are several parameters which influence the horizontal range, the most critical of which is ejection velocity of the bomb. Most bombs are ejected away from the aircraft in a direction perpendicular to the aircraft and the velocity can have a range from 0 – 50 ft/s, depending on bomb weight, ejection force, flow field interaction, etc). This has a great effect on horizontal range, particularly for low altitude releases.

Each actual bomb has a specific ejection velocity. The Modified Practice Bomb also has one specific ejection velocity which may not correspond with the values of any of the actual bombs. If the ejection velocity is different between the practice bomb and the actual bomb, the horizontal range will differ even if the ballistic coefficient is perfectly matched. For example, a perfect match in horizontal range may be achieved at a R.A. (release altitude) of 300 ft only. The match is acceptable for the release envelope from 100 – 500 ft R.A., but perhaps it would not be acceptable for a R.A. of 1000 ft. Therefore limits of match are generally limited within a specified release envelope.

In practice, it is not necessary to match these parameters precisely and this depends on the extent of the release envelope and requirements for accuracy in the match in horizontal range. For example, for the matching of the MK-82 Low-Drag bomb, trajectory calculations have shown that an acceptable match in horizontal range is achieved even when the $C_D$ of the MPB is more than 25% larger than the desired value of 0.14 required for a perfect match, within the specified release envelope. In general, the requirement for a closer match in ballistic coefficient is related to time of flight (i.e. the longer the time of flight to greater the need to match the ballistic coefficient more closely). For the case of ejection velocity, the difference in horizontal range will be greater for shorter time of flight. A difference in ejection velocity of 10 ft/s will have a great effect on horizontal range for low altitude release (e.g. 200 ft) and practically none for high altitude releases (e.g. 1000 ft) Thus, a "close match" in ballistic coefficient and hence horizontal range is effectively a compromise between the various parameters and the requirements for accuracy in the match in horizontal range.

Horizontal range matching of several actual bombs is achieved by starting with an M.P.B. configuration designed for minimum drag and a ballistic coefficient tailored to match the longest horizontal range. For shorter horizontal ranges the coefficient of drag is increased to achieve a ballistic match. This is achieved by appropriate modification of the minimum drag configuration.

This basic configuration is defined by a fixed effective diameter of about 2 in and a substantially constant weight of about 6 lb.

Looking at the formula for calculating ballistic coefficient, wherein $$\text{Ballistic coefficient} = C_D A/W \text{ wherein } A = \pi d^2/4$$

and wherein $C_D$ = coefficient of drag,
$A$ = cross-sectional area,
$d$ = diameter, and
$w$ = weight;

In the above formula, if the diameter of the Modular Practice Bomb is effectively fixed and its weight is kept substantially constant, the only parameter that can be varied is the coefficient of drag.

It will be appreciated that the term "substantially" has been used, since any increase in weight due to modifications to vary the coefficient of drag is minimal in relation to the total weight of the Modular Practice Bomb. The term "effectively fixed" has also been used, the effective diameter being the largest diameter of the MPB excluding the tail fins or modifications.

Figure 2:
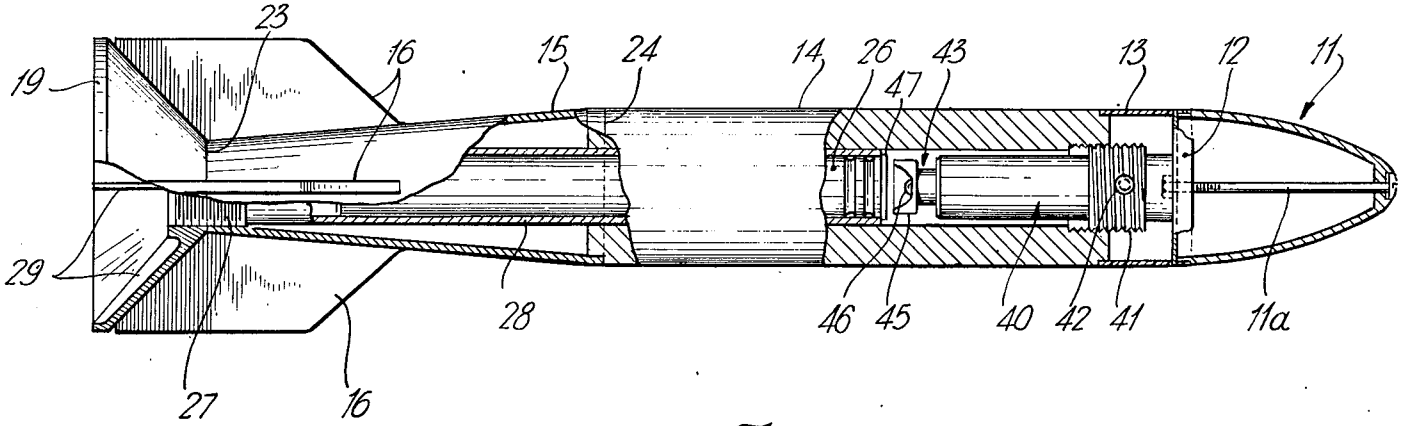

In the drawing which serve to illustrate the embodiments of the invention, wherein like reference numerals represent like parts, FIG. 1 is a perspective view of the Modular Practice Bomb, according to the invention, FIG. 2 is a side elevation of the MPB according to the invention, partly in section, to illustrate its internal construction.

Figure 2A:
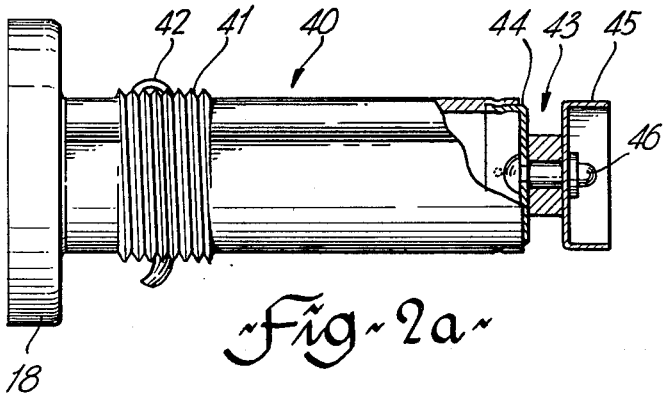
Figure 6:
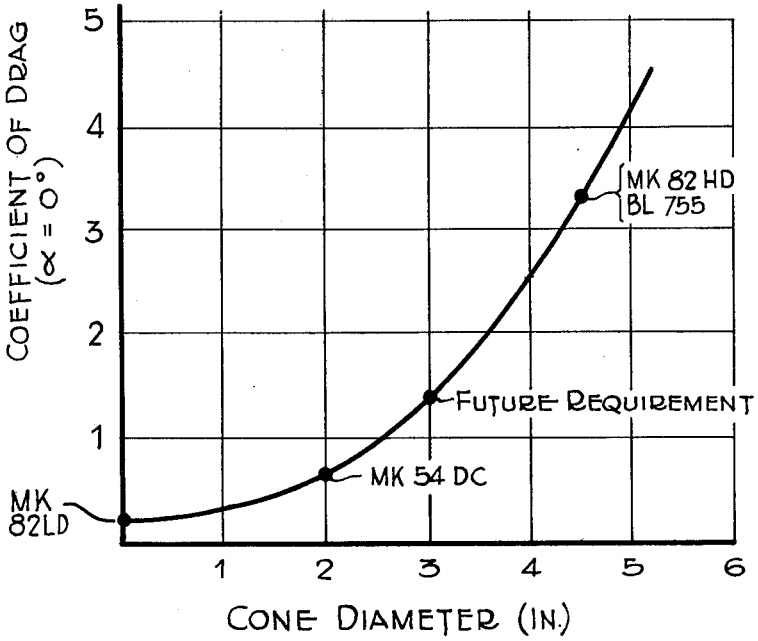
Figure 7:
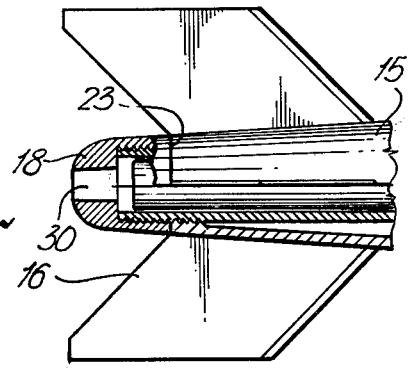
Figure 4:
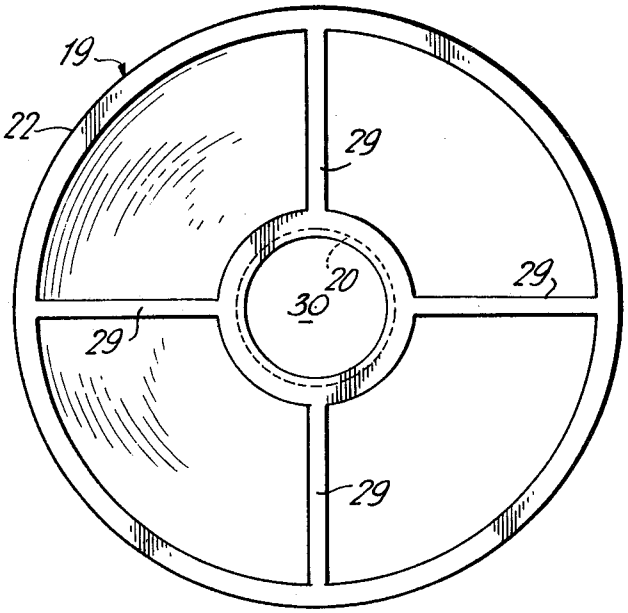
Figure 3:
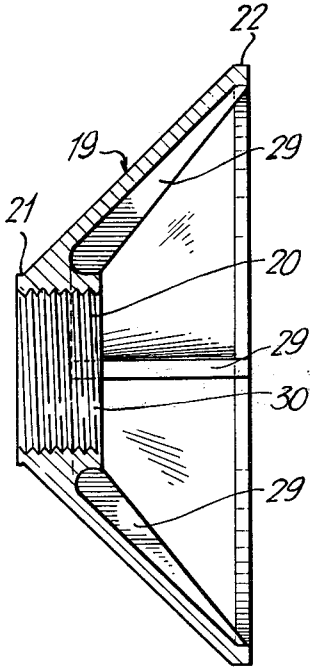

FIG. 2*a* is a side elevation, partly in section, of the firing mechanism of the MPB according to the invention. This Figure is located on the page of drawings including FIGS. 6 and 7, FIG. 3 is a side elevation, in section, of a typical frusto-conical tail module according to the invention, FIG. 4 is a plan view of a tail module according to the invention, illustrating its internal construction, FIGS. 5*a* to 5*d* are side elevations, illustrating various tail modifications according to the invention, FIG. 6 is a graph of coefficient of drag of the MPB versus cone diameter, and FIG. 7 is a partial side elevation of the MPB partly in section, to illustrate the attachment of a tail fairing according to the invention.

With specific reference to the drawings, the Modular Practice Bomb (MPB) 10 comprises a generally cylindrical configuration of an effective diameter of about 2 in, having a fineness ratio (length ÷ diameter) of about 8.3 and a weight of about 6 lb.

More specifically, the MPB 10 is seen to comprise a nose section 11 in the form of a tangent ogive with a blunt nose and is made of a suitable frangible plastics material which is designed to collapse upon impact with the ground to avoid ricochet. A suitable plastic material is low density polyethylene. The nose section 11 is attached to a striker plate 12 which is in the form of a forward facing metal cup, by means of a long screw 11a which threads into the plate 12.

A frangible collar 13 separates the nose section 11 from a central body section 14. The collar 13 is constructed of a suitable plastics material e.g. high density polyethylene. The central body section 14 is cylindrical and conveniently made from extruded thick wall carbon steel tubing.

A tail section 15 in the form of a frustum of a cone is provided including four equally spaced stabilizing fins 16. The tail section 15 defined by a smaller diameter 23, and a larger diameter 24 which corresponds to the effective diameter of the MPB, is conveniently threaded onto the central body section 14. The tail section 15 is conveniently made of a suitable moulded plastics material.

A tail fairing 18 is used in the lowest drag configuration, and to increase the coefficient of drag is replaced by a frusto-conical tail module 19 of an appropriate diameter to produce the desired coefficient of drag. See FIGS. 5*a* to 5*d*. With particular reference to FIGS. 3 and 4, the tail module 19 is defined by a smaller diameter 21 which corresponds to the smaller diameter 23 of the tail section 15 and by a larger diameter 22 which determines the coefficient of drag of the MPB.

The tail module 19 has an internal threaded portion 20 which provides for convenient attachment to external thread 27 on the MPB. The central portion of the module 19 is open as at 30 to allow for a flow through of gases which result from ignition of the burster and spotting charge. Reinforcement is provided by means of four equally spaced ribs 29. Conveniently, the cone from which the tail module 19 is formed is a 45° cone. However, it will be appreciated that the cone angle is not critical and, for example, may be varied between 30° and 60°.

It will be appreciated that the nose section 11, collar 13, tail section 15 including fins 16, tail fairing 18 and tail cone 19, may be molded from the suitable materials referred to above.

The internal configuration of the MPB is seen in FIG. 2.

The striker plate 12 is electrically welded to a striker assembly 40. The striker assembly 40 extends through a tubular collar 41 and into the body section 14. The tubular collar 41 is threaded into the body Section 14, the striker assembly 40 being held in position by means of a shear pin 42 extending therethrough.

As best seen in FIG. 2*a*, the striker assembly 40 includes a firing assembly 43 comprising an outer cup 44 staked to the striker assembly 40. An inner stand-off cup 45 protects a firing pin 46.

The stand-off cup 45 is spaced from a ring element 47 which protects the burster and spotting charge, which are conveniently provided in a single cartridge 26.

The body section 14 includes a steel tube 28 which is provided with an exteriorly threaded extension 27 to co-operate with internal threading 20 on the tail cone 19 or on the tail fairing 18, to facilitate detachment and interchangeability.

In operation, upon impact with the ground, the nose cap 11 and collar 13 collapse and the pin 42 shears, allowing the striker assembly 40 to be driven backwards. The inner cup 45 is thus crushed against the ring element 47, permitting the firing pin 46 to contact the cartridge 26 and set off the burster and spotting charge. Thus, visible smoke is produced to provide a visual indication of the impact point for scoring purposes.

The procedure for matching the horizontal range of the MPB with that of a predetermined live bomb is as follows:

A predetermined actual bomb, for example, the MK-82 Snakeye Low-Drag Bomb, is first selected. Its ballistic coefficient may be calculated from known information. This value is then equated to that of the MPB to provide a "ballistic match" and hence a good simulation of the horizontal range of the MK-82 Low-Drag Bomb. An appropriate fixed weight (about 6 lb) and effective diameter (about 2 in.) for the MPB are selected, which from the "ballistic match" the coefficient of drag for the MPB may be calculated.

From wind-tunnel and aero-ballistic range data i.e. Table I, a graph of the $C_D$ of the MPB versus cone diameter (see FIG. 6) may be drawn. Appropriate cone diameter for predetermined bombs may then be extrapolated from this graph if the $C_D$ of the MPB is calculated as above. In these experiments an MPB was fitted with tail cones of varying diameter and their coefficients of drag measured.

TABLE I

| BOMB SIMULATION | CONE DIAMETER (in) | COEFFICIENT OF DRAG |
|---|---|---|
| MK-82 Low-Drag | No cone | 0.18 |
| MK-54 Depth Charge | 2.0 | 0.63 |
| Future requirement | 3.0 | 1.35 |
| MK-82 High-Drag | 4.5 | 3.40 |
| BL:755 Cluster Bombs | 4.5 | 3.40 |

More specifically, the most difficult horizontal range to match is that of the MK-82 Snakeye I Low-Drag Bomb. To achieve an acceptable horizontal range match, the lowest drag MPB has to be used which can be determined by equating the ballistic coefficients and solving for $C_D$. Accordingly, $$\left(\frac{C_D A}{W}\right) MPB = \left(\frac{C_D A}{W}\right) MK\text{-}82\ LD$$

-continued $$\therefore C_D MPB \simeq \frac{\dfrac{\left(.45 \times \frac{\pi}{4}\ 10.75^2\right)}{570}\ MK\text{-}82\ LD}{\left(\dfrac{\frac{\pi}{4}\ 2^2}{.6}\right) MPB}$$

$$\therefore C_D MPB \simeq .14$$

This value of $C_D$ of 0.14 is smaller than the minimum value of 0.18 for the MPB, but trajectory calculations show that the measured value of $C_D$ of 0.18 for the MPB is close enough to achieve an acceptable match in horizontal range for the specified release envelope. It would be possible to increase the low drag range by simply increasing the weight of the MPB by increasing the length of the center body. To match the horizontal range of other bombs it is necessary to increase $C_D$ and this can be achieved by adding a tail cone of appropriate diameter at the rear of the MPB. Thus, the MPB has a substantially constant weight of 6 lb and a fixed diameter of 2 in.

Conveniently, the $C_D$ of the MPB is increased by replacing the tail fairing of the minimum drag configuration with a frusto-conical tail module of an appropriate diameter.

If one wanted to simulate the horizontal range of the MK-82 High-Drag Bomb, the appropriate value for the coefficient of drag of the MPB is calculated as follows:

$$\left(\frac{C_D A}{W}\right) MPB = \left(\frac{C_D A}{W}\right) MK\text{-}82\ HD$$

$$\therefore C_D MPB \simeq \frac{\dfrac{\left(13.4 \times \frac{\pi}{4} \times 10.75^2\right)}{570}\ MK\text{-}82\ HD}{\left(\dfrac{\frac{\pi}{4} \times 2^2}{6}\right) MPB}$$

$$\therefore C_D MPB \simeq 4$$

Theoretically, the $C_D$ of the MPB must be increased to about 4. However, the MK-82 Snakeye I HD mode of operation is different than that of the MPB. This bomb is released in the low drag mode ($C_D \simeq 0.45$) and after one second of flight large fins open to produce high drag ($C_D \simeq 13.4$). For an acceptable horizontal range match it can be demonstrated from trajectory calculations that $C_D$ for the MPB should be about 3.4. The value of 4.0 calculated above corresponds to fins open from the time of release. Thus, a value of $C_D$ of less than 4 is required for an horizontal match.

Figure 5:
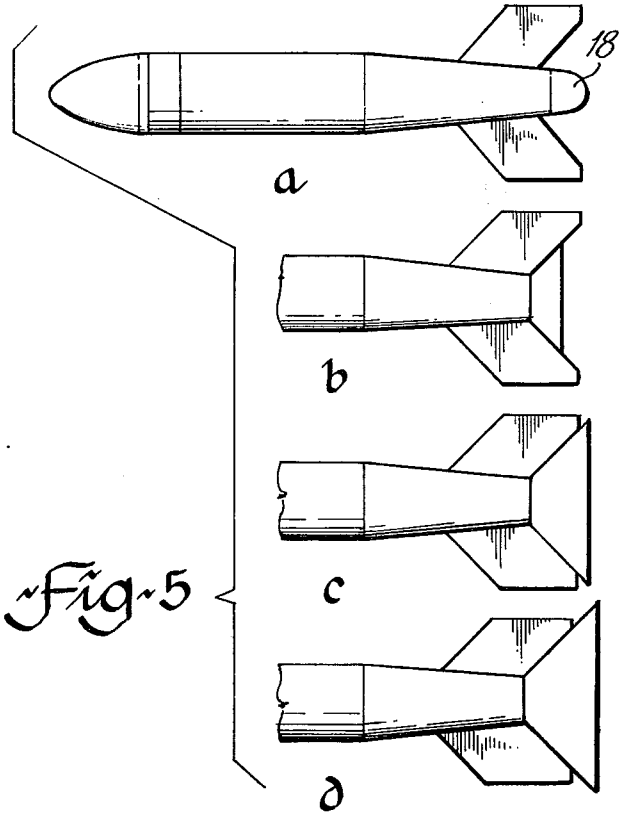

With regard to FIG. 5, embodiment *a*, is the low-drag configuration with tail fairing 18. This modification is used to simulate the horizontal range of the MK-82 Snakeye Low-Drag Bomb. Embodiments *b* to *d* illustrate modifications including 3.0 in, 4.5 in and 5.5 in diameter tail cones. The 4.5 in tail cone is used in the simulation of the MK-82 Snakeye High Drag Bomb as well as the BL-75 Cluster Bomb. The other two embodiments may be useful for future requirements.

Referring to FIG. 6, it is seen that a coefficient of drag of about 3.4 corresponds to a tail cone diameter of about 4.5 in. Thus, if a 4.5 in. diameter tail cone is mounted on the MPB, a $C_D$ of about 3.4 will be achieved and a close simulation of the horizontal range of the MK-82 High-Drag Bomb results for the specified release envelope.

Referring again to FIG. 6, which shows the variation of estimated drag coefficient ($C_D$) with cone diameter, the lowest $C_D$ value for MPB is approximately 0.18 at subsonic speeds and it rises non-linearly with cone diameter to a value of 5 for a cone diameter of about 5.5 in. This represents an increase in drag of more than 25 times and it is considered to be large enough to cover the entire range of ballistic coefficients and horizontal ranges of present and future bombs.

The light weight, simple construction and use of proven burster spoting charge combination should make the MPB competitively priced with current practice bombs in production. It would be compatible with both the SUU-20/A and CMNIA bomb dispensers with only minor changes to accommodate its smaller diameter. Its capability of simulating a broad range of ballistic coefficients and bomb horizontal ranges through the use of various sized tail cones cannot be over-emphasized. This will allow the MPB to simulate the horizontal range of a future, undefined, weapon with only the possible expense of a new plastic tail cone.

In view of the various embodiments described above, it should be apparent to those skilled in the art that the present invention may be embodied in forms other than those specifically described herein without departing from the spirit or central characteristics of the invention. Thus, the specific embodiments described above are to be considered in all respects as illustrative and not restrictive.

The embodiments of the invention in which an exclusive property of privilege is claimed are defined as follows:

1. In a practice bomb for closely simulating the horizontal range of an actual bomb within acceptable limits under various release conditions, said practice bomb comprising:

(a) a nose section, (b) a cylindrical central body section, and (c) a tail section including a plurality of stabilizing fins spaced about the longitudinal axis of the body, the improvement comprising providing a standard configuration Modular Practice Bomb of fixed effective diameter and substantially constant weight, and including means for varying the coefficient of drag of the Modular Practice Bomb while maintaining flight stability, said means comprising a detachable tail module mounted on said tail section and a rigid frusto-conical configuration coaxial with said longitudinal axis and between said fins.

2. A Modular Practice Bomb according to claim 1, wherein said nodule is made of a plastics material.

3. A Modular Practice Bomb according to claim 1, wherein said the cone from which the frustum is derived is a 45° cone.

4. A Modular Practice Bomb according to claim 3, wherein the fixed effective diameter is about 2 in. and wherein said substantially constant weight of the Modular Practice Bomb is about 6 lb.

5. A Modular Practice Bomb according to claim 4, wherein said larger tail or cone diameter is variable between about 1.5 in. and about 5.5 in. to vary the coefficient of drag of the Modular Practice Bomb between about 0.5 and about 5.5.

6. A Modular Practice Bomb according to claim 5 wherein the larger diameter is about 5.5 in.

7. A method of closely simulating the horizontal range of a wide variety of actual bombs within acceptable limits under various release conditions, comprising providing a standard configuration Modular Practice Bomb of fixed effective diameter and substantially constant weight, and varying the coefficient of drag of the Modular Practice Bomb to provide a close match of the ballistic coefficient and horizontal range of the Modular Practice Bomb with that of a predetermined actual bomb, while maintaining flight stability, within a specified release envelope by calculating the drag coefficient of said practice bomb required to match the drag coefficient of said actual bomb and increasing the drag coefficient of said practice bomb to said calculated value by providing the practice bomb with a detachable tail-mounted module of an appropriate configuration.

8. The method of claim 7 including replacing said module with detachable tail fairing.

9. The method of claim 7 including providing said standard configuration at about a 2 inch diameter and a weight of about 6 pounds.

10. The method of claim 7 including varying the minimum coefficient of drag of the practice bomb from about 0.18 to about 5. by replacing the tail module.

11. The method of claim 7 including selecting a tail module having a frusto-conical configuration having a smaller and a larger diameter and attaching the configuration to the practice bomb at its smaller diameter.

12. The method of claim 11 including varying said larger diameter between 1.5 inches and 5.5 inches.

13. The method of claim 11 including selecting said module from those having a 45° angle.

14. The method of claim 11 including selecting a module having a large diameter of about 4.5 inches and obtaining a coefficient of drag of about 3.4.

* * * * *